US006851153B2

(12) United States Patent
Lehman

(10) Patent No.: US 6,851,153 B2
(45) Date of Patent: Feb. 8, 2005

(54) TOOTHBRUSH

(75) Inventor: James P. Lehman, 1708 Eric La., Libertyville, IL (US) 60048

(73) Assignee: James P. Lehman, Libertyville, IL (US)

( * ) Notice: Subject to any disclaimer, the term of this patent is extended or adjusted under 35 U.S.C. 154(b) by 295 days.

(21) Appl. No.: 10/157,550

(22) Filed: May 29, 2002

(65) Prior Publication Data

US 2003/0221272 A1 Dec. 4, 2003

(51) Int. Cl.[7] ..... A46B 9/04
(52) U.S. Cl. ..... 15/167.1; 15/DIG. 5
(58) Field of Search ..... 15/159.1, 167.1, 15/DIG. 5

(56) References Cited

U.S. PATENT DOCUMENTS

| | | | | |
|---|---|---|---|---|
| 1,059,426 | A | | 4/1913 | Barnes |
| 1,382,681 | A | | 6/1921 | Segal |
| 1,520,954 | A | | 12/1924 | Kastelle |
| 1,901,646 | A | | 3/1933 | Hicks |
| 1,943,225 | A | | 1/1934 | McIntyre |
| 2,040,245 | A | | 5/1936 | Crawford |
| 2,117,174 | A | | 5/1938 | Jones |
| 2,130,661 | A | | 9/1938 | Zaebst |
| 2,139,245 | A | | 12/1938 | Ogden |
| 2,186,005 | A | | 1/1940 | Casto |
| 2,253,210 | A | | 8/1941 | Psiharis |
| 2,274,042 | A | | 2/1942 | Cosby |
| 2,304,319 | A | | 12/1942 | Saltzman |
| 2,306,482 | A | | 12/1942 | Livingston |
| D140,438 | S | | 2/1945 | Cohen |
| 2,651,068 | A | | 9/1953 | Seko |
| 2,978,724 | A | | 4/1961 | Gracian |
| 3,072,944 | A | | 1/1963 | Clayton et al. |
| 3,188,673 | A | | 6/1965 | Newman |
| 3,229,318 | A | * | 1/1966 | Clemens ..... 15/167.1 |
| 3,263,258 | A | | 8/1966 | Burge |
| 3,742,549 | A | | 7/1973 | Scopp et al. |
| 4,010,509 | A | | 3/1977 | Huish |

(List continued on next page.)

FOREIGN PATENT DOCUMENTS

| | | |
|---|---|---|
| CH | 107827 | 11/1924 |
| DE | 12405 | 5/1901 |
| DE | 81229 | 8/1934 |
| DE | 2728672 | 1/1979 |
| FR | 569971 | 9/1924 |
| FR | 6.95325 | 12/1930 |
| FR | 794.580 | 2/1936 |
| IT | 325419 | 6/1936 |

*Primary Examiner*—Randall Chin
(74) *Attorney, Agent, or Firm*—James P. Lehman

(57) ABSTRACT

An improved toothbrush for superior cleaning in the embrazure(74) and occlusal groove(66) areas of the dentition. A handle (28), a neck(26), and a head portion(16) are connected in sequence. The head portion has a non planar shaped face(12). This shape can be mathematically represented by the combination of a sine wave(37) and a parabola (18). Inserted into non planar face(12) are bristles with varying inertia and orientation. Stiffer peak bristles(48) with higher inertia are positioned most adjacent to the dentition promoting better penetration and better strength yielding better cleansing ability in areas of the dention that most need it; interproximal tissue(74) which is most susceptible to gum disease and occusal groove(66) area which is most susceptible to decay. More supple outer row bristles(52) have lower inertia and are in a recessed position which promotes softer contact and protection of the most prominent and delicate areas of the dentition.

9 Claims, 3 Drawing Sheets

Figures 1, 2:
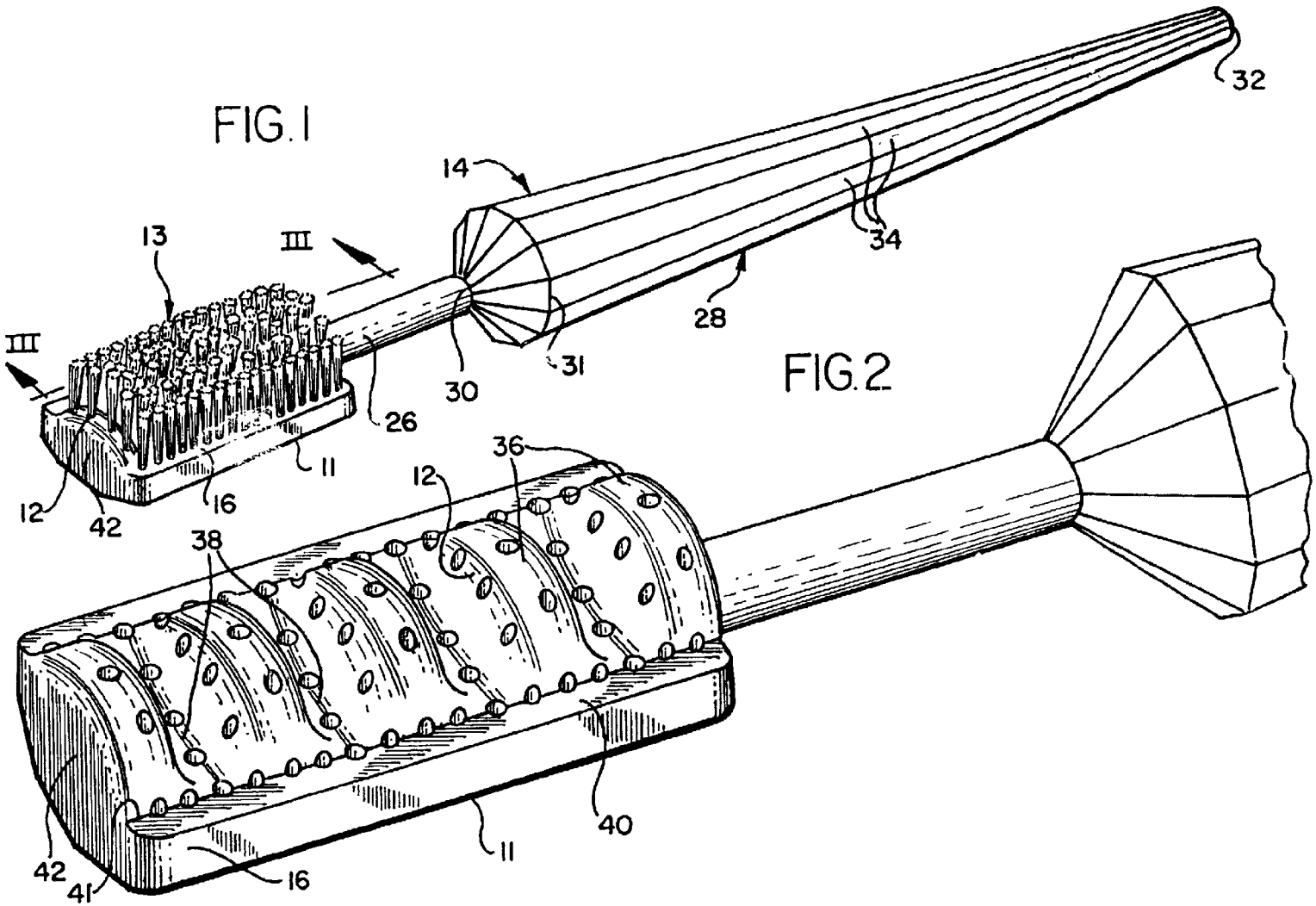

U.S. PATENT DOCUMENTS 4,288,883 A 9/1981 Dolinsky
4,356,585 A 11/1982 Protell et al.
4,472,853 A 9/1984 Rauch
4,679,273 A 7/1987 Okin
4,847,936 A 7/1989 Moglianesi et al.
5,305,489 A * 4/1994 Lage ..... 15/167.1
5,306,151 A * 4/1994 Rauch ..... 433/216
5,419,001 A * 5/1995 Wan ..... 15/167.1
5,926,898 A * 7/1999 Kramer ..... 15/167.1
6,035,476 A * 3/2000 Underwood et al. ..... 15/22.1
6,276,021 B1 * 8/2001 Hohlbein ..... 15/167.1
2003/0126704 A1 * 7/2003 Bailey-Teets ..... 15/167.1

* cited by examiner 32
34
28
31
14
30
26
III
11
16
13
42
12
III 36
12
38
40
11
16
42
41

TOOTHBRUSH

BACKGROUND OF INVENTION

1. Field of Invention

This invention relates to toothbrushes specifically to an improved shape of the toothbrush head and corresponding ends of the bristles.

2. Discussion of Prior Arts

Throughout history toothbrushes predominantly have been flat in shape. The main function of earlier toothbrushes was to remove superficial food particles and decrease the risk of cavities forming. The war on cavities won a major victory with the completion of a successful 1950's public water fluoridation campaign. Most major cities converted over to fluoridated water and as a result less cavities formed and people retained their teeth longer. These same teeth that were protected by the fluoridated water became subject to another silent tooth killer in gum disease. After the age of 35, gum disease became the most prevalent cause of tooth loss. In response to an increase in incidence of gum disease many tooth brushes evolved that had stiffer bristles and raised outer bristle bundle rows which stimulated the gum tissue. An example of one such toothbrush would be the Reach by Johnson and Johnson. Later toothbrush manufacturers found out that the negative effect of all this stimulation was gum recession and root surface abrasion. To this end, toothbrush manufacturers made the bristles softer with rounded and polished ends. There were ensuing complaints from users that these softer brushes lacked a certain feel that was stimulating and invigorating. Additionally, there was some clinical evidence that these softer brushes didn't rid the plaque and subsequent gum disease from the most prone areas in between the teeth. This brought about the latest barrage of tooth brushing devices.

Proxabrushes, stimudents, and a number of contoured brushes have recently made their way to the forefront to address this need to stimulate the gums between the teeth. Some of the contoured brushes such as the Crest Complete by Proctor and Gamble and Reach In Between by Johnson and Johnson are a copy of U.S. Pat. No. 3,188,673 to Newman 1964Mar. 4. These contoured brushes penetrate the interproximal (between the teeth) area better than flat brushes. There are several short comings of these contoured brushes.

The contoured brushes only contour and conform to the tooth shape in the direction of the front of the mouth to the back. It does not take into account any tooth contour in the direction from the gum line to the tooth edge or from buccal (cheek side of tooth) to lingual (tongue side of tooth). Accordingly the outer row of bristles of the contoured brushes splay or bend outward during usage. After prolonged usage the splaying becomes permanent and signifies that a toothbrush is worn out.

The pressure exerted on the dentition (tooth and gum tissue) by the outer row of bristles of this contoured brush can also damage the gum and the hard tissue. This same outer row pressure prevents the inner row from advancing and obtaining maximum penetration. This lack of penetration prevents stimulation and invigoration. It also exhibits how poorly the contour brush conforms to the tooth. Another disadvantage of the contour brush is the limited size variations to conform with different users tooth widths. The assumption is that everyone has the same width of teeth. A large man or woman may also have a small tooth width which might confuse the user as to what brush to select.

Another shortfall of the contoured brush is the lack of strength of the bristles bundles in the center row. This weakens the bristles ability to clean and stimulate.

In order to obtain the needed strength for the inner bristle bundles to clean better the contour brush would have to add mass to the bristle bundles. There are three ways to add mass to bristle bundles to get better cleaning and all three have short comings. Firstly; you increase the diameter of each bristle and the bundles get bigger but more brittle, less flexible, and less able to penetrate into the deepest grooves. Less flexible, brittle bristles bundles lose their ability to sweep the food out once they have engaged it. Secondly; you increase the density or number of bristles per bundle you still will only get a certain amount of the bristles penetrating to the deepest grooves. This will result in no significant in crease in strength. Thirdly; you change the material that the bristles are made of to one that is harder and you increase the strength but lose the flexibility and gain brittlelessness. If you could increase the mass of the inner bristle bundles using one of these three examples and for the sake of argument it did increase the cleaning power, it would still be cost prohibitive to manufacture a brush using different materials and parameters for different bristle bundle locations, these facts conclude that the contoured brush design is inadequate for any future strength enhancing modifications.

The bristle bundles of the outer row are conversely too strong and their positioning brings them into contact with the gum tissue and tooth where damage does occur in the form of gum recession and abrasion. The contour bundles woefully lack the design to allow bristles to penetrate unencumbered to the deepest recesses with enough strength to clean, stimulate and protect gumline areas. This lack in design leaves the tooth more susceptible to gum disease where it most frequently starts-between the teeth. It also is responsible for gum recession and root surface abrasion in the midfacial area of the tooth. One final consequence of the design flaw is the formation of cavities in the two most susceptible spots—occlusal (biting) area and interproximally.

SUMMARY OF THE INVENTION

The present invention overcomes the disadvantage of prior art toothbrushes by providing a toothbrush which incorporates significant concrete improvements in connection with the structure and design of the toothbrush. More specifically the shape of the toothbrush face allows us to place bristle bundles in key areas that can access the dentition better. Each of these bristle bundles have substantially improved and yet very individual properties and characteristics that make this brush clean, more completely with less wear and tear on the brush and dentition. The brush head design allows more bristle pressure to be applied to the recessed areas of the dention thus yielding better cleaning and stimulating ability. Contrarily the brush head design allows less bristle pressure to be applied to the more prominent areas of the dentition thus yielding less wear and tear on the dentition and brush.

This would also reduce abrasion of the gum tissue and root surface. It would also reduce pain to the root surfaces in individuals with a condition known as root surface hypersensitivity. In these individuals, constant wear of the root surface opens up nerve endings increasing root sensitivity to temperature exceeding the normal. Gentle but thorough removal of plaque has been proven the best long term treatment for this condition. This is exactly what my brush is intended to do. This tooth brush would be inexpensive to manufacture and have a wide variety of sizes for the user to select. As will be described later in the specification a device can be provided to help them determine what size brush to select for their individual tooth width.

I believe that this toothbrush does a superior job cleaning and stimulating the most important areas pertaining to gum disease and cavity prevention while protecting the most vulnerable areas to toothbrush abrasion. This will result in healthier, less damaged gums and teeth, and a longer lasting toothbrush. Accordingly the objects and advantages of the invention are:

a) to provide a toothbrush which better penetrates into grooves and embrazure spaces between teeth.

b) to provide a toothbrush with a curvaceous non planar brush head face that envelopes varying lengths of the individual bristle bundles.

c) to provide a toothbrush with more plastic enveloping the bristles which are oriented to penetrate the furthest into the grooves and embrazure spaces.

d) to provide a toothbrush with shorter stronger bristles in the best position for maximum penetration e) to provide a toothbrush where the shorter bristles are stronger and clean better due to the better position of these bristles f) to provide a toothbrush with bristle bundles having more strength, better positioning, better penetration, and less bristle mass in the form of thickness, gage or special material then similarly designed bristle end configurations.

g) to provide a toothbrush which would sweep and clean better because the most protruding bristle bundles resist deformation because they are shorter and penetrate better because they are thinner in gage and bristle density.

h) to provide a toothbrush where the multilevel bristle end shape can be set one level at a time allowing each level to be rounded and polished, an important manufacturing requirement.

i) to provide a toothbrush that requires only one set length of bristle to be cut, thus making it easier to manufacture.

j) to provide a toothbrush which is gentle on the gum and hard tissue yet stimulates and cleans grooves and embrazure spaces.

k) to provide a toothbrush that stimulates for those people who crave the firmer sensation on their gum tissue l) to provide a toothbrush that gives a gentler feel to people with sensitive root surfaces by endrounding, and polishing all bristles and recessing the outer row of bristles.

m) to provide a toothbrush that meets with the shape of the teeth and gums both in a mesial to distal (front to back) and gingival to occlusal (top to bottom) direction.

n) to provide a tooth brush that promotes a more even pressure throughout the bristle end configuration.

o) to provide a toothbrush that will last longer and splay less because of better mechanical design and less pressure exerted on the outer row of bristles.

p) to provide a toothbrush with recessed or shorter outer rows to decrease gum and tooth abrasion.

q) to provide a toothbrush with a shape and feel that will be interpreted by the user as novel and therefore more effective r) to provide a toothbrush with a plastic brush head face which can be produced and modified, especially on the computer, by using the mathematical formula on the x,y,z, coordinate system as follows: $y=a+b\cos(k(z-c))+d(x)^2$ where $d=(-0.667-\cos 2.5z)/4$ the letters a, b, k, and c are constants that modify the shape of the combination sine wave and parabola and the notation "^" before the number denotes exponent.

s) to provide a toothbrush where the basic design shape and size of the brush head face can easily manufactured and/or modified using a mathematical formula described above on a CAD/CAM or similar computer programs.

t) to provide a toothbrush where the design protects the roots of the teeth from erosion, sensitivity, and ultimate need for restoration.

u) to provide a toothbrush with a tapering cylindrical handle with multiple flat sides to promote better gripping and rotary motion by the user v) to provide a toothbrush that has a variety of sizes that correspond with the widths of the users' teeth.

w) to provide a toothbrush where the size of the brush head can be selected in the store by the user with a device that measures self inter occular distances which in turn correlates to the width of the users teeth x) to provide a toothbrush that cleans better in between and on the biting surfaces of teeth preventing decay and gum disease where it is most frequently detected.

y) to provide a toothbrush that cleans and sweeps the occlusal groove and interproximal area better possibly slowing or arresting decay where it most frequently starts.

z) to provide a toothbrush that stimulates and cleans better in between the teeth and possibly slows or arrests gum disease where is most frequently starts.

Further objects and advantages of the invention will become apparent from a consideration of the drawings and ensuing description.

DRAWING FIGURES

FIG. 1: A perspective view of the toothbrush

FIG. 2: A perspective view of the toothbrush less the bristles and with handle part cut off FIG. 3: A side elevational view of the toothbrush in FIG. 1 cut along the line III—III FIG. 4: An end view of the toothbrush in FIG. 3 cut along the line IV—IV FIG. 5: A cross sectional view of the toothbrush in FIG. 3 cut along the line V—V FIG. 6: A cross sectional view of the toothbrush in FIG. 3 cut along the line VI—VI FIG. 7: A top plan view with a preferred arrangement of bristle bundles designated with numbers to correspond with their differing heights.

Figure 4:
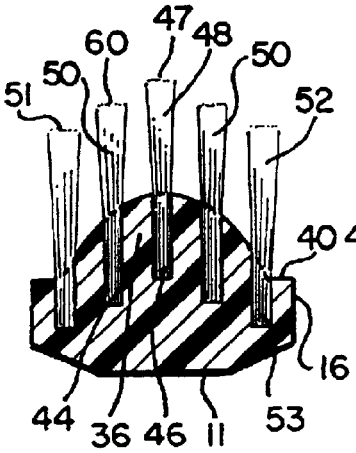
Figure 8:
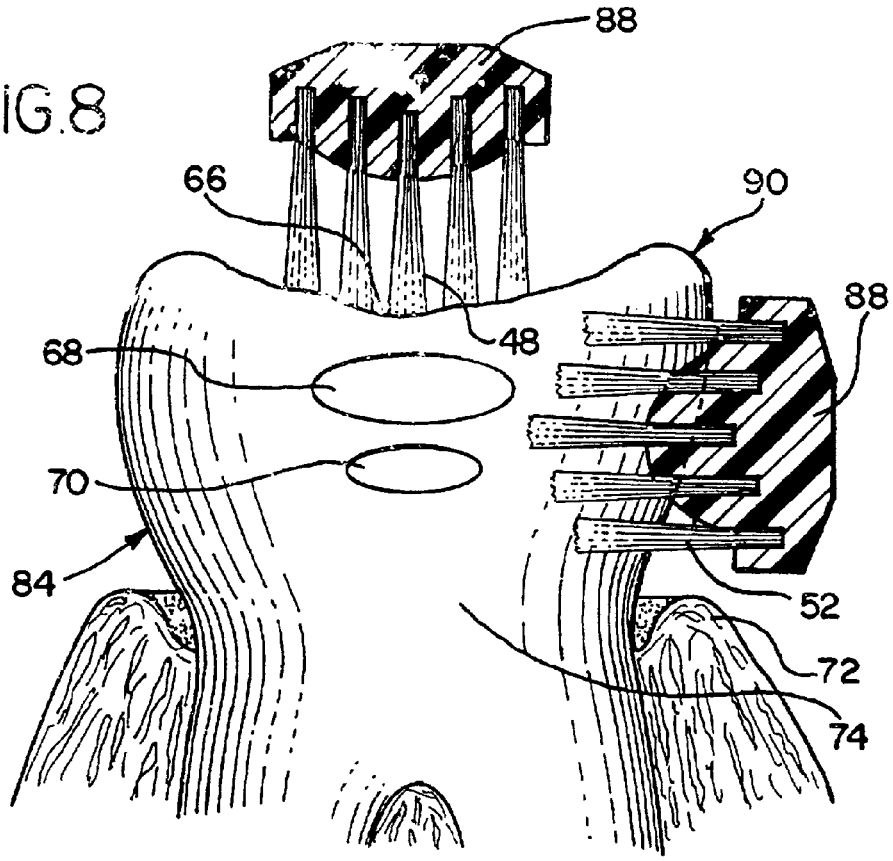

FIG. 8: Two separate views of FIG. 4 showing bristle contact with occlusal groove and embrazure areas of a tooth with associated gum tissue.

Figure 9:
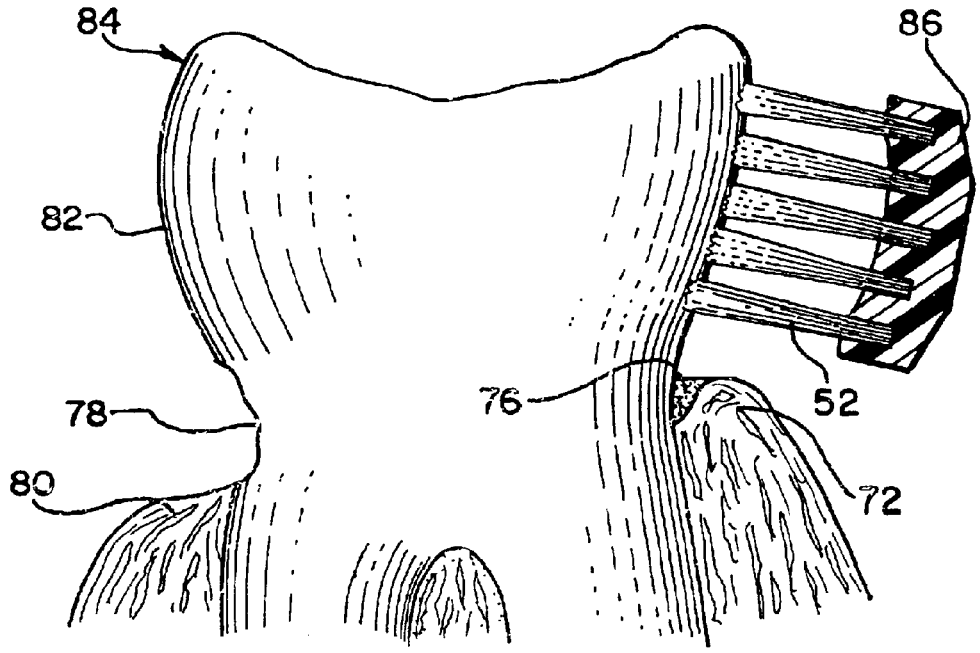

FIG. 9: Across sectional view of the toothbrush in FIG. 3 cut along the line VI—VI showing bristle contact with the most prominent or convex of the side of the tooth and gum tissue

REFERENCE NUMERALS IN DRAWINGS

11 back of toothbrush head
12 Non planar face

13 same length bristle bundles toothbrush
14 toothbrush
16 head of toothbrush
18 parabolic cross-section
20 outer row of bristle bundles
21 cross sectional row of bristle bundles
22 middle most row of bristle bundles
23 transitional cross section row of bristle bundles
24 longitudinal row of bristle bundles
25 cross sectional row of bristle bundles
26 shank of toothbrush
28 handle
30 shank handle junction
31 widest part of handle
32 pointed end of handle
34 plurality of flat sides
36 peak area
37 sine wave shaped curve
38 valley area
40 outer shelf
41 junction line
42 head end
44 material embedded part end
45 valley bristle bundle free end
46 peak bristle bundle embedded part
47 peak bristle bundle free end
48 peak bristle bundle
49 bristle bundles on slope free end
50 bristle bundle on a slope
51 Free end of outside bristle bundle
52 bristle bundles in the outer row
53 material embedded portion of outerrow bristles
54 bristle bundle on a slope
55 material embedded portion
56 bristle bundle on slope
57 free end of bristle on slope 54
58 material embedded portion
59 free end of bristle on slope 56
60 free end of bristle on slope 50
62 bristle bundle on a slope
63 material embedded part
64 valley bristle bundles
65 valley bristle bundle embedded part
66 occlusal groove
68 contact area to adjacent tooth
70 area most prone to interproximal decay
72 outer free gingival margin
74 interproximal gum tissue
76 gingival sulcus
78 root surface abrasion
80 gingival recession
82 wear resistant enamel
84 tooth
86 toothbrush cross section of valley bristle area
88 toothbrush cross section at peak bristle area
90 cusp tip

DETAILED DESCRIPTION OF THE INVENTION

As seen in FIG. 1, a toothbrush 14 includes a generally rectangular head 16 with a head end 42 a back of toothbrush head 11 and a non-planar face 12 from which projects a multitude of same length bristle bundles 13. These same length bristles bundles 13 are embedded at different depths into the non planar face 12. The head 16 is connected to a handle 28 by a small diameter shank 26. The shank 26 has a diameter less than ½ the diameter of the head 16. The shank 26 rapidly tapers outward from a shank handle junction 30 to a widest part of the handle 31. The handle 28 more slowly tapers from the widest part of the handle 31 to a pointed end of the handle 32. The handle 28 is generally cylindrical along it's length but has a plurality of flat sides 34 which are easily and firmly gripped by the fingers of the user so that the handle can be easily rolled or rotated during the scrubbing action of the teeth.

Figure 5:
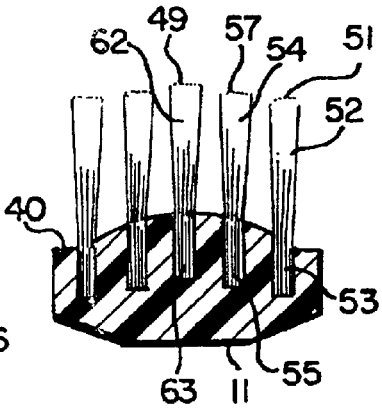
Figure 6:
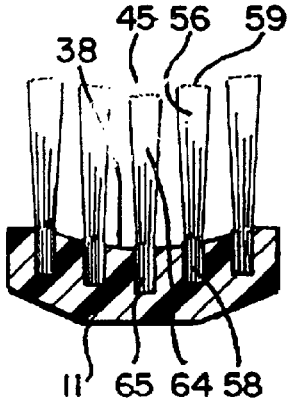
Figure 7:
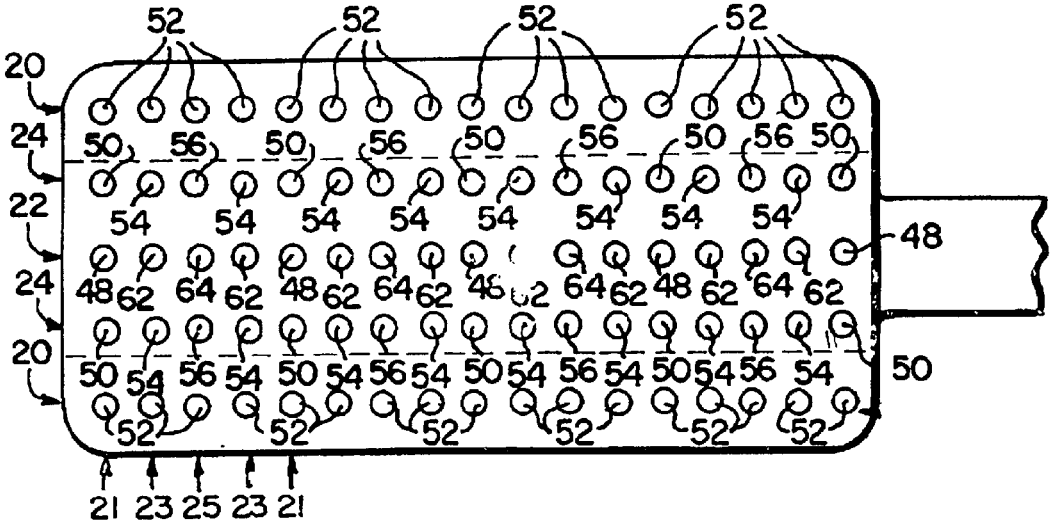

The same length bristle bundles 13 as illustrated in FIGS. 1, 3, 4, 5, and 6 firmly embedded in the head 16. These bristle bundles 13 are embedded at varying depths depending on the bristle bundles location. As seen in FIG. 4 a bristle bundle 52 has an embedded portion 53 into the material of the brush head. This embedded portion 53 of bristle bundle 52 has the shortest penetration into the material of the brush head 16 of all the bristles used in the brush head. Referring to FIG. 7, the bristle bundles 52 is the same for all bristle bundles in an outer row of bristle bundles 20. This outer row bristle bundles 20 is located on an outer shelf 40 as seen in FIGS. 1, 2, 4, 5, and 6. This outer shelf 40 borders the non planar face 12 on the two sides which run longitudinally the length of the brush head 16. This outer shelf 40 can be found in a plane that is perpendicular to the placement of the bristle bundles 13 as best illustrated in FIGS. 3, 4, 5, and 6.

Figure 3:
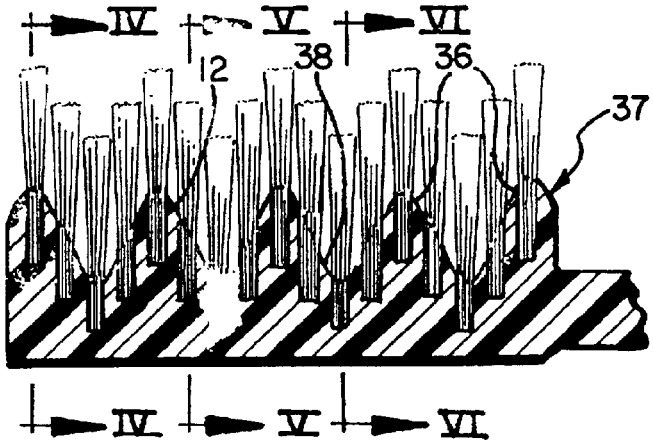

The bristle bundles 52 have a free end 51 located on the end of the bristle bundle opposite or away from the material embedded part 53. The free ends 51 of all the bristle bundles 52 are located in a plane which is parallel to the plane in which the outer shelf 40 is located. Between the two outer shelf 40 borders lies the non planar face 12, as seen in FIG. 2. The non planar face 12 is comprised of a peak area 36, a valley area 38 and points in-between connecting the two areas. There are multiple peak areas 36 and valley areas 38 along the length of the non planar face 12. There are also points connecting the peak area 36 and the valley area 38 with the outer shelf 40. These points in between are on the non planar face 12 and generally follow the curvature of a surface generated when you mathematically combine a sine wave function with a parabolic function. The sine wave portion of the surface can be seen by taking longitudinal slices of the brush head 16 as seen in FIG. 3. A sine wave shaped curve 37 defines the points between the peak area 36 and valley area 38. Every longitudinal slice of the brush head 16 taken from the non planar face 12 will contain points on a curve defined as a sine wave. Other longitudinal slices will have a different amplitude or highs and lows as compared to the sine wave in FIG. 3. A parabolic shaped cross section 18 of the non planar surface 12 can be seen in FIGS. 4, 5, and 6. Every cross sectional slice of the brush head 16 taken from the non planar face 12 will contain points on a curve defined as a parabola. Other cross sectional slices will have different shaped parabolas then the area illustrated in FIGS. 4, 5, and 6. To understand and make the non planar face 12 shown in FIG. 2 a person only needs to know basic algebra and trigonometry. To briefly bring you through the steps needed to generate the surface we need to start with the basic formula for a sine wave. $y=\cos z$ on the y, z coordinate system. Expanding that formula to obtain variations on the shape of the sine wave you have $y=A+B\cos(K(z-C))$ where A, B, K, and C are constants whose change in value will change the slope or location of the sine wave. Changing A will shift the entire sine wave curve up or down. Changing B will increase or decrease the amplitude of the curve or the amount of curve that stretches along the y or vertical axis. Changing K will stretch or shrink the curve along the z or horizontal axis. Changing C will shift the entire curve right or left along the horizontal or z axis.

Having defined the constants the next step in explaining how to make the; shape of the surface is to introduce and combine the parabolic function which will give us a third dimension to the sine wave along the x axis, y=A+B cos (K(z−C))+d (x)^2. Constants are picked according to the needs of the surface to be generated. The slope d of the surface can be solved at the intersection of the non planar surface 12 and the outer shelf 40 where we can assign a unit value for x at 2 and y at 0. Other values for the constants are assigned but can be varied to accommodate different shaped and width of users teeth. These values are A=0.667 units, B=1 unit, K=2.5 units C=0. Unit values are to be determined but can equal 3 mm.

With all of the constants given and solving the equation at the intersect point where x=2 and y=0 then the slope d=(−0.667−cos 2.5 z)/4. What this means is that for every value z along the horizontal axis we get a different value d for the slope of the cross-sectional parabola at that intersect point. Even though formulas are discouraged it would seem prudent to include this formula and a short explanation to define the shape of the non planar face 12 and how someone skilled in the art could make this. Since CAD-CAM or Computer Aid Design and Computer Aid Machinery is used in the development and production of many parts, then to be able to define the complex non planar face 12 in a mathematical or computer terms would seem important. To give parameters or ranges for these constants would make a sufficient variety of tooth brushes which would protect the invention from duplication or copy.

The constant A can vary from −1 to 1. The constant B can vary from ½ to 2. The constant K can vary from ½ to 5. The constant C can vary from 0 to 2 pi or 2(3.1415). Unit value can vary from 1 mm to 10 mm. This equation produces a surface that has alternating high and low areas as shown in FIG. 2 and these areas repeat at least 3 to 4 times through the non planar face 12. Any toothbrush with a repeating high and low shape face where the highest area and lowest areas are in the mid most longitudinal section and where those areas taper outwardly to common outer level would be an infringement on the invention.

The non planar face 12 is a complex surface which is bordered on two sides by the outer shelf 40. The points where the non planar face 12 and outer shelf 40 touch or meet comprise a junction line 41. This junction line 41 is straight and can be parallel to the junction line on the opposite side of the non planar face 12. Both outer shelf 40 areas can be contained in the same plane. In FIG. 3 the surface generated by this longitudinal section is best described as a sine wave shaped curve 37. The bristle bundles 13 embedded into the material in this longitudinal section are referred to as a middle most row of bristle bundles 22. Unlike the outer row of bristle bundles 20 which are set the same height, the middle most row of bristle bundles 22 have bristle bundles set at different levels. Each individual bristle bundle 13 in this mid most row 22, with the reference to the plane pertaining the outer shelf 40, is set at a level corresponding to the surface of the non planar face 12. A valley bristle bundle 64 as seen in FIG. 3 and FIG. 6 is set at the corresponding valley area 38 as seen in FIGS. 2, 3 and 6. This valley bristle bundle 64 has a free end 45. The valley bristle bundle free end 45 is located on the side of the bristle bundle away from the non planar face 12. The valley bristle bundle 64 has an embedded part 65. The valley bristle bundle embedded part 65 is located on the side of the bristle bundle closest to the non planar face 12. This embedded part 65 is as deep into the material of the non planar face 12 as the embedded part 53. The valley bristle bundle free end 45 is the closest or shortest distance of any other free end to the plane containing the outer shelf 40. Reference to this plane will be made to help visualize each individual free end and it's relative importance in the overall structure and function of the toothbrush. A bristle bundle on a slope 62 as seen in FIGS. 3 and 5 is also set in the mid most row of bristle bundles 22. It has a free end 49 and an embedded part 63. The bristle bundle on a slope free end 49 can be found at a position further away from the aforementioned outer shelf plane then the valley bristle bundle free end 45. Due to the irregular slope of the non planar face 12 the material embedded part 63 is set deeper into the material then both embedded part 65 and embedded part 53. This would leave less of the bristle bundle on a slope 62 to be free of the material then both bristle bundles 52 and 64. That would give the bristle bundle on a slope 62 more strength and a better opportunity positionally to reach the teeth and gums.

A peak bristle bundle 48 as seen in FIGS. 3 and 4 is also set in the mid most row of bristle bundles 22. It has a peak bristle bundle free end 47 and a peak bristle bundle material embedded part 46 The peak bristle bundle free end 47 can be found at a position furthest away from the aforementioned outer shelf plane then all other free ends that comprise this toothbrush. Due to the irregular shape of the non planar face 12, the peak bristle bundle material embedded part 46 is set deeper into the material then all other material embedded parts that comprise this toothbrush. This would have the least amount of the peak bristle bundles 48 to be free of the material then all other bristle bundles. The peak bristle bundle 48 would have more strength as a result of this and a better opportunity positionally to reach the deep recesses of the teeth and gums. The description of all the bristle bundles in the middle most row of bristle bundles 22 is complete. The next task is to describe all the bristle bundles in transitional longitudinal row of bristle bundles 24 as seen in FIG. 7. The transitional longitudinal row of bristle bundles 24 is comprised of three different bristle bundle types all of which are placed in the material at varied depths. The junction between the embedded part and the free part of these three bundles is located on the non planar face 12. The junction points of these bristle bundles to the non planar face 12 are contained in tangent planes which are non parallel to the plane containing the outer shelf 40. In plain terms the bristle bundles are placed in the non planar face 12 on a slope. These insert or junction points on the non planar face 12 of theses three bristle bundles are located closer to the outer shelf 40 plane than the peak area 36.

A bristle bundle on a slope 50 as seen in FIG. 4 can be set on the non planar face 12 between the bristle bundles in the outer row 52 and peak bristle bundle 48. The bristle bundle on a slope 50 has a free end 60 and a material embedded part 44. The free end 60 is located closer to the outer shelf 40 plane than is peak free end 47 but further from the outer shelf 40 plane than is free end 51. The material embedded part 44 is set deeper into the material then the embedded part 53 but not as deep as the embedded part 46. A bristle bundle on a slope 54 as seen in FIG. 5 can be set on the non planar face 12 between the bristle bundles in the outer row 52 and the bristle bundles on a slope 62. The bristle bundle on a slope 54 has a free end 57 and a material embedded part 55. The free end 57 is located closer to the plane containing outer shelf 40 than is the peak free end 47 but further than is free end 51. The material embedded part 55 is set deeper into the material then the embedded part 53 but not as deep as the embedded part 63.

A bristle bundle on a slope 56 as seen in FIG. 6 can be set on the non planar face 12 between the bristle bundles in the outer row 52 and the valley bristle bundles 64. The bristle bundle on a slope 56 has a free end 59 and a material embedded part 58. The free end 59 is located closer to the plane containing the outer shelf 40 than is the free end 51 but further then is valley free end 45. The material embedded part 58 is set approximately the same depth into the material as both embedded part 53 and embedded part 65. The bristle bundles, their parts and location on the brush face have been introduced. It would be helpful to now take a step back and give an overcall description of these same bristle bundles.

There are seven distinct bristle bundles described in this specification. Each having a different orientation and insertion into the non planar face 12. FIGS. 4, 5, and 6 are cross sections of the toothbrush in FIG. 3 cut along the lines IV—IV, V—V, and VI—VI respectively. They give us representative views of all seven different types of bristle bundles found in this toothbrush. FIG. 4 is also represented by a cross sectional row of bristle bundles 21 as seen in FIG. 7. FIG. 5 is also represented by a cross section row of bristle bundles 23 as seen in FIG. 7. FIG. 6 is also represented by a cross section row of bristle bundles 25. Each of these cross sectional row of bristle bundles appears in a repeating sequence along the length of the non planar face 12.

These three cross sections represent the changes of the properties that the toothbrush undergoes from the head end 42 to the shank 26. The exact spacing of these cross sections can vary with the width and height of the user's teeth. Using the aforementioned mathematical formula one may construct a toothbrush with widely varying distances between the repeating sequence of bristle bundles. In plain terms the distance along the length of the planar face 12 between two peak areas 36 can vary widely. A person with wide but short teeth can be as accommodated with a well fitting tooth brush as would a person with narrow but long teeth. The formula mentioned before will help the skilled person in this art to manufacture these variations in this same toothbrush.

A device placed on the store shelf will aid the user in determining the size toothbrush to select. A photo of an object possibly a toothbrush will be on two separate plastic films, which can be adjusted width wise. When the user adjusts the width of the device until the objects appear as one, then the user can look at the bottom of the device for an indication of their inter occular distance. Inter occular distance can be used as a reasonable indicator of general tooth width. Wide eyes usually means wide tooth width and vice versa. This toothbrush will be more effective if the width of the repeating sequence of peak and valley bristles matches the width of the users teeth.

The bristle bundles contained in this invention can work successfully as a group only if there are individual properties unique to certain bristle bundles in certain locations. The strongest bristle bundle is the peak bristle bundle 48 as seen in FIG. 4. The strength characteristic of this bristle bundle coupled with it's peak location give this bristle bundle the ability to clean and stimulate better than any other bristle bundle in this toothbrush. It may well clean and stimulate better than any other bristle bundle in any toothbrush made. The placement of the peak bristle bundle 48 in the middle most row of bristle bundles 22 will further facilitate penetration into two areas which need cleaning the most, an occlusal groove 66 area and an area most prone to interproximal decay. 70 as seen in FIG. 8. An interproximal gum tissue 74 area is adjacent to the interproximal decay 70 area and also benefits from the stimulating effects of the peak bristle bundle 48.

It is often thought that the reason why interproximal decay forms just below a contact area to an adjacent tooth 68 is because plaque and small food particles can accumulate disturbed in this area. A combination of food particles and plaque form an acid which shifts the balance of calcium exchange to the depletion side until the calcium laced matrix of the tooth collapses. Therefore it is important to rid this area of plaque and food particles to prevent such acid formation. The peak bristle bundle 48 does just this in a very efficient way.

To understand the unique properties of peak bristle bundle 48, a description of the internal physical properties needs to be discussed. The peak bristle bundle 48 is enveloped in substantially more material than any other bristle bundle. This leaves us with an effectively shorter free end to the peak bristle bundle. This shorter peak bristle bundle 48 is stiffer but has the same amount of bristles and the same diameter bristles as any other bristle bundle in this tooth brush. The fact that it is stiffer with the same diameter and number of bristles is very important. The peak bristle bundle 48 can penetrate better than similar stiffness bristle bundles with thicker diameter bristles or with more bristles contained in the bundles. Once penetration to important occlusal groove 66 or interproximal decay 70, areas the peak bristle bundles 48 can sweep and clean with increased strength and efficiency.

The reason for better penetration to the occlusal groove 66 and interproximal decay 70 areas is twofold. Firstly, the peak bristle bundle 48 has less mass, less diameter and less dense bristles then similar stiffness bristles. Secondly, the orientation of the peak bristle bundle 48 allows it's free end to be the first to come in contact with the denition unencumbered. One other important characteristic of the peak bristle bundle 48 is the improved sweeping and cleaning ability. To fully appreciate this we need to imagine a larger model. The first model that comes to mind is a broom. If you cut the broom bristles down in length then the bristles would be stiffer but they would still contact the floor with the same density and overlap. This is important because if you increase the diameter or density of the bristles then the dirt particles don't get pushed along the floor as well. The dirt particles bounce off of the ends of the denser wider diameter bristles and don't get a chance to get caught in between the bristles and get carried along or swept away as well. Therefore the bristles with increased stiffness and no increase in mass are better for cleaning then equally stiff bristles with increased mass.

The peak bristle bundle 48 as seen in FIG. 4 is flanked on two sides by bristle bundles on a slope 50. The bristle bundles on a slope 50 as compared to peak bristle bundle 48 is in a less penetrating position, has a longer effective free end and is less stiff. The bristle bundle on a slope 50 contacts the dentition closer to the CEJ or gumline then peak bristle bundle 48. The tapered or recessed position of bristle bundle on a slope 50 combined with a softer less stiff bristle bundle provides us with a free end that will do less damage or abrasion to the more vulnerable CEJ areas. The recessed positioning of bristle bundle on a slope 50 will allow peak bristle bundle 48 to penetrate further into interproximal about tissue 74 areas and occlusal groove 66 areas then bristle bundle on a slope 50.

Bristle bundles in the outer row 52 are located between bristle bundles on a slope 50 and the outer shelf 40. The bristle bundle in the outer row 52 as compared to the bristle bundle on a slope 50 is in a less penetrating position, has a longer effective free end and is less stiff. The bristle in the outer row contacts the dentition closer to the CEJ or gumline then the bristle bundle on a slope 50. The tapered or recessed position of the bristle bundle in the outer row 52 combined with a softer, less stiff bristle bundle provides us with a free end that will do even less damage or abrasion to the vulnerable CEJ areas then bristle bundle on a slope 50. The recessed positioning of the bristle bundles in the outer row 52 will allow peak bristle bundle 48 and bristle bundle on a slope 50 to penetrate further into interproximal gum tissue 74 and occlusal groove 66 areas then bristle bundles in the outer row 52.

These are three types of bristle bundles depicted in FIG. 4. The peak bristle bundles in 48 are the tallest, most penetrating, with the shortest free end and the stiffest properties. The bristle bundle on a slope 50 are less tall, less penetrating, longer free end and is less stiff then peak bristle bundle 48. Bristle bundles in the outer row 52 are the shortest least penetrating with the longest free end and the softest of the three bristles depicted. There are three types of bristle bundles depicted in FIG. 5. Bristle bundle on a slope 62 is taller, more penetrating, has a shorter free end, and is stiffer then the other two types of bristles in FIG. 5. Bristle bundle on a slope 62 is shorter, less penetrating, has a longer free end and is softer then peak bristle bundle 48. Bristle bundle on a slope 54 is shorter less penetrating has a longer free end and is softer then bristle bundle on a slope 62. Bristle bundle on a slope 54 is longer more penetrating has a shorter free end and is stiffer then bristle bundle in the outer row 52. The bristle bundles in FIG. 5 are positioned to maximize contact and minimize damage to the convex tooth shape and to maximize contact and cleaning power to the occlusal groove 66 area.

There are three types of bristle bundles depicted in FIG. 6. Valley Bristle bundles 64 are shortest, least penetrating, have the longest free end and is softest then all other bristle bundles in this toothbrush. The importance of this fact cannot be overstressed. Valley bristle bundles 64 contact the most convex part of the side of the tooth while brushing. The two facts that it is the softest and the most recessed bristle bundle yield three very important results. It allows the other bristles to penetrate and exert more force cleaning and scrubbing the interproximal 74 areas better. The recessed positioning softened, and flexibility allow this to happen. Additionally less pressure exerted on the convex surfaces prevents enamel wear or abrasion and excessive or premature toothbrush wear.

The last bristle bundle to discuss is the seventh different type of bristle bundle described in this invention disclosure. Bristle bundle on a slope 56 is located between valley bristle bundle 64 and bristle bundles in outer row 52. The positioning of this bristle bundle in slope 56 maximizes contact with the convex tooth surface.

With the position and physical properties important to function of the bristle bundles expounded, a brief description of the toothbrush in contact with tooth structure would be helpful. FIG. 8 shows an overall view of a tooth 84 and gum tissue with the toothbrush in contact with the top and side of the tooth. An outer free gingival margin 72 can be seen on the side of the tooth adjacent to the free gingival margin 72 is the shorter bristle bundle in the outer row 52. Adjacent to the area most prone to interproximal decay 70 is the peak bristle bundle 48. Peak bristle bundle 48 is also very close to the interproximal gum tissue 74. It can be observed in this part of FIG. 8 that peak bristle bundle 48 extends, cleans, and stimulates the interproximal gum tissue 74 area most prone to decay 70. It can also be observed that the recessed bristle bundles in the outer row 52 are in proximity to the free gingival margin. The longer, more supple bristle bundles of the outer row cause less abrasion and wear to the tissue and tooth surface. The part of the toothbrush cross section of peak bristles 88 contacts interproximally between contact area of adjacent tooth 68 and interproximal gum tissue 74. The peak bristle bundles 48 are able to penetrate the area bristles are tapered shorter on both sides of the peaks bristle bundle 48. The peak bristle bundle 48 is stiffer then any other bristle and by nature of it's position make it able to clean and stimulate interproximally better then any other brush.

Likewise the occlusal groove 66 area is prone to decay and food impaction. It can be observed in this part of FIG. 8 that the peak bristle bundle 48 extends, cleans and stimulates this area which is most prone to occusal decay. It can also be observed that the recessed bristle bundles in the outer row 52 are in proximity to a cusp tip 90. These bristle bundles have longer more supple free ends but are recessed from the peak bristle bundles 48. Their flexibility and recessed positioning allow better penetration of the peak bristle bundles 48. The firmness of the peak bristle bundles added density or mass promotes better cleaning by these peak bristle bundles 48.

FIG. 9 is a representation of a tooth 84 with a toothbrush cross section of valley bristle area 86 in contact and with the most convex portion of the side of the tooth. A healthy gingival sulcus 76 as well as outer free gingival margin 72 can be seen adjacent to the outer row of bristles 52. Illustrated on the opposite side of tooth 84 is an area of root surface abrasion 78, an area of gingival recession 80, and an area of wear resistant enamel 82. The toothbrush and its associate parts have been described in complete detail. A description of how it all functions together will help clarify this toothbrush's unique features.

Three important areas about the toothbrush operation that will be described are cleaning superiority, dentition protection, and toothbrush longevity. Cleaning superiority can best be demonstrated by referring to FIG. 8. Peak bristle 48 can penetrate and physically contact and clean occlusal groove 66 and interproximal decay area 70 which are deep recessed areas. The peak bristle bundles 48 are able to do this superior job for four reasons. Firstly, their location as the most protruding bristle bundle gives them an advantage. Secondly, the other bristle bundles of this tooth brush are less protrusive and less likely to get bound up on the surrounding tooth or gum surface. Thirdly the peak bristle bundles are stronger without the need for increased mass or density of the bristle material. Fourthly, the outer row of bristles 52 is more flexible and less likely to prevent the toothbrush from reaching the important recessed areas.

The peak bristle bundle 48 has a free end 47 that measures the farthest distance away from the plane containing the surface of the back of the toothbrush head 11. This makes the peak bristle bundle 48 most accessible to the most recessed areas of the denition (teeth and gums). The regular peak and valley shape of the non planar face 12 closely resembles the peak and valley shape of the free ends of the bristle bundles. The peaks 36 are a little more pronounced then the positioning of the peak bristle bundles 48.

This means that the peak bristle bundles 48 are enveloped in more material and have an effective shorter free end. The distance from the non planar face 12 to the free ends 47 of the peak bristle bundles 48 is therefore shorter. This shorter bristle can be loaded with more enertia or latent energy. A shorter bristle is stiffer and can absorb more flexing energy. This increased energy absorption is also accompanied by an increase in the bristle recoil. It is this increased recoil that gives us a better cleaning motion of the bristle. This shorter stiffer more protruded peak bristle bundle 48 is also more accessible to narrow recessed areas. The improved access can be attributed to three qualities of this bristle bundle in combination with one another. The most obvious quality is its protruded position. It is the first bristle bundle which makes unobstructed contact with the tooth surface. The second quality is the bristle shortness which makes the bristle bundle more stiff. Even through it is protruding further from plane containing the outer shelf 40, the peak bristle bundle 48 is enveloped by more material of the non planar face 12 then are the rest of the bristles. Thus yielding a shorter stiffer bristle . This stiffer peak bristle bundle 48 will not bend as easily and thus help it to penetrate. The third quality is more complicated and to understand it we need to compare mass and density of bristles to their stiffness. If we had two bristle bundles of the same length and same material we would need to increase the mass of one of the bundles to increase the stiffness. Therefore to increase stiffness of a bristle bundle we would need to increase either the density or gage (thickness) of the individual bristles or both. This would also result in increased mass of the bristles. Increase mass or amount of bristle material logically results in decreased accessibility to narrow recessed places. Stiffness is a prerequisite for bristles to accessing recessed spaces without bending or splaying away from the intended location. Therefore if you can obtain stiffness with less bristle mass you are further ahead toward obtaining the goal of reaching into narrow recessed areas. This toothbrush accomplishes this by its unique non planar face. The peak bristle bundle 48 is surrounded by more material of the peak area 36 of the non planar face 12 resulting in a shorter free end which is stiffer, has less mass is oriented in a protruded manner and is physiologically capable of accessing narrow recessed areas. A most important concept to understanding the importance and uniqueness of my tooth brush is the ratio between bristle mass and bristle enertia. Bristle enertia is the energy that a bristle can absorb during flexure. If you can increase the bristle enertia without increasing bristle mass then you have made huge progress toward improved cleaning of tight recessed areas. If you can further orient this bristle with increased events and constant mass in such a way as to protrude above the other bristles when you have made huge progress toward improved cleaning of tight recessed areas. The toothbrush here is oriented in a protruded position with increased enertia with the same bristle diameter and density (mass) as all the other bristles in this toothbrush. Therefore we have achieved the goal of improved cleaning in high recessed areas.

The toothbrushes that are on the market today, the Crest Complete and the Reach in Between, to name a couple, which are a copy of U.S. Pat. No. 3,188,673 to Newman 1964 Mar. 4 have bristles that are longer and may attempt to reach narrow recessed areas. The truth of the matter is that these longer bristles are too supple to do any real accessing of these tight areas. A non planar face 12 is necessary in strengthening the bristles that have the most protruded free. ends. The peak bristle bundles 48 truly do clean superiorly while the rest of the toothbrush is concerned more with dentition protection. Referring to FIG. 9 the cross section of the valley bristle area 86 is illustrated. This portion of the toothbrush will contact the most convex part of the tooth and mate with even pressure across all five bristles. Additionally the bristles in the outer row 52 are the most supple gentlest. This is important because this outer row of bristles 52 contacts the outer free gingival margin 72. It is the outer free gingival margin 72 and associated root surface which is very susceptible to toothbrush bristle abrasion resulting in gingival recession and root surface wear grooves. So this toothbrush protects the most vulnerable tooth and gum structures by distributing the forces throughout all the bristles and by keeping the outer bristles the softest. Final operational advantage of this toothbrush is its resistance to splaying of the bristles. Splaying is a phenomenon by where the bristles bend and permanently deform in a direction away form the center of the brush. The outer row of bristles 52 are most affected by this phenomena.

Referring to FIG. 8 it can be observed that the toothbrush cross section at peak bristle area 88 has free ends that are in a "V" shaped configuration. As previously discussed, this configuration allows maximum penetration by the peak bristle bundles 48 but it also helps protect the outer bristles 52 from excessive pressure discouraging bristle bundles 48 but it also helps protect the outer bristles 52 from excessive the phenomenon called splaying. Additionally in FIG. 9 the toothbrush cross section at valley bristle area 86 mates with or contacts evenly with the tooth surface. Even pressure is illustrated with design and splaying is kept to minimum.

CONCLUSION

Thus the reader can see that the toothbrush of the invention provides superior cleaning, sweeping, and stimulation because of better penetration and more bristle strength. This toothbrush is easy to manufacture because only one uniform bristle length is used. The bristles area end rounded and polished easily after you set each level of bristles. The size of the brush head and the placement of bristles into the non planar brush face can be modified using the mathematical formula $y=a+b \cos (k(z-c))+d(x)^2$ where a, b, k, and c are constants and $d=(-0.667-\cos 2.5\ z)/4$. This toothbrush protects gum tissue and root surfaces by mating with the teeth and promoting even presume throughout the brush. The end result is a toothbrush that feels better and the bristles don't wear out and splay as fast. The tallest or peak bristles 48 slide or catch the interproximal recesses thus promoting an up and down useage. The peak bristles 48 also have the potential for absorbing the most energy making them the most effective bristles. To accommodate the users individual tooth size, a wide variety of widths of brushes are provided. The most important aspect of fitting the toothbrush to the user is to make sure the peak bristle bundles 48 coincide with interproximal spaces between the users' teeth. A device can be placed on store shelfs to help the user identify the proper width toothbrush to select. This is done by measuring interoccular distances and relating them directly to the users tooth widths. Lastly, the novel look and feel of the brush makes the user psychologically feel like they are using a superior brush. While my above description contains many specificities, these should not be constructed as limitations on the scope of the invention, but rather as an exemplification of one preferred embodiment thereof Many other variations are possible. For example the peak area 36 of the non planar face 12 can be modified by increasing its height and changing the stiffness of the peak bristles 48. Another example could be to increase the distance between peak areas 36 accommodating the user who has wider teeth. Accordingly, the scope of the invention should be determined not by the embodiment illustrated, but by the appended claims and their legal equivalents.

I claim as my invention:

1. A toothbrush which comprises:

a rounded handle and a head on one end of said handle having a) a longitudinally elongated face, b) a back flat side of the head opposing the face, and c) a plurality of bundles of bristles embedded in said head and projecting from said face and terminating with a free end cumulatively creating a bristle end contour arranged in five to eight longitudinal rows in transversely spaced relation and with the bundles in each row being longitudinally spaced, there being two outboard rows, one on each side of the longitudinal length of the head, and the remainder of longitudinal rows are classified as inboard rows, the bristle bundles in the outboard rows having uniform heights to lightly engage the gums of the teeth being scrubbed and the bristle bundles in the inboard rows having variable heights that simultaneously mate with and scrub a group of adjacent teeth, the longitudinally elongated face of the brush head being contoured to similarly match the bristle end contour of both outboard and inboard rows thereby presenting a mirror image of a group of adjacent teeth to be scrubbed, whereby humans can thoroughly brush their dentition more efficiently with greater bristle contact and force, at the same time yielding less harm to the teeth and gums.

2. Toothbrush of claim 1 wherein some of the bristle bundles in a central inboard row have the free ends which are oriented to project the furthest distance from the toothbrush head as measured from the back flat side of the head of the toothbrush creating a peak area of bristle bundles and the longitudinally elongated face is contoured to envelope said inboard row of bristles as much as any other bristle bundle leaving a free end length the same as every other bristle bundle in this toothbrush whereby these peak areas of bristle bundles would be more capable to access recessed areas of a dentition and to provide a more even pressure throughout the bristle end contour.

3. Toothbrush in claim 2 wherein some of the most central inboard row bristle bundles have a shorter bristle length measured from the back flat side of the head and a stiffer bristle quality whereby these shorter stiffer bristle bundles possess less mass, less bristle density and less bristle material stiffness than longer bristle bundles of equal stiffness which provides these bristle bundles with an unequaled opportunity to penetrate smaller, tighter areas with more vigor than any other bristle bundles could.

4. Toothbrush in claim 3 wherein the outboard row of bristle bundles are less enveloped by the toothbrush face material than are the peak bristle bundles whereby a softer more supple bristle bundle is produced in the outboard rows and with the same amount, length, and type of bristle bundle material used throughout the brush there is created the softer recessed outboard row of bristle bundles and the stiffer peak area of bristle bundles in the central inboard row.

5. Toothbrush in claim 4 wherein a mathematical formula defining the face of the toothbrush incorporates both the sine wave and parabolic functions on the x, y, z coordinate system according to the formula; y=a+b cos kz-b cos kc+dx^2 where d=−0.667/4−cos2.5 z4 and the letters a, b, c, and k, are constants that modify the shape of the combination sine wave and parabola and the notation ^ denotes an exponential function.

6. A toothbrush which comprises:

an elongated handle and a head on one end of said handle having a) a longitudinally elongated face, b) a back flat side of the head opposing the face c) a plurality of bundles of bristles embedded in said head and projecting from said face exposing a free end of said bristle bundle and cumulatively creating a bristle end contour and with said brush head having an undulating surface spaced inwardly from an outer shelf edge which completely borders the face thereof, wherein said undulating surface mirrors the shape of a group of adjacent teeth, the bristles are embedded to create a shape with the bristle bundle free ends that mates with and scrubs an adjacent group of teeth, the bristle bundles have a variability of exposed length depending on the position of the bristle bundles, there are two outboard rows, one on each side of the longitudinal length of the head, in the outer shelf area and the remainder of the longitudinal rows are classified as inboard rows, to yield a variable bristle stiffness whereby humans can brush their teeth more thoroughly without damaging their teeth and gums.

7. Toothbrush of claim 6 wherein some of the bristle bundles in the central part of the undulating surface of the elongated face are oriented with the free ends projecting the furthest distance from the toothbrush head as measured from the back flat side of the head creating a peak area of bristles and the longitudinally elongated face is contoured to envelope said inboard rows of bristles as much as any other bristle bundle leaving a free end length the same as every other bristle bundle in this toothbrush whereby these peak areas of bristle bundles would be more capable to access recessed area and to provide a more even pressure throughout the bristle end contour.

8. Toothbrush in claim 7 wherein some of the most central inboard row bristle bundles with a shorter bristle length as measured from the back flat side of the head to the end have a stiffer bristle quality whereby these shorter stiffer bristle bundles possess less mass, less bristle density, and less bristle material stiffness than longer bristle bundles of equal stiffness which provides these bristle bundles with an unequaled opportunity to penetrate smaller, tighter areas with more vigor than any other bristle bundle could.

9. Toothbrush in claim 8 wherein the outboard row of bristle bundles are less enveloped by the toothbrush face material than are the peak bristle bundles whereby a softer, more supple bristle bundle is produced in the outboard rows and with the same amount, length, and type of bristle bundle material used throughout the brush there is created the softer recessed outboard row of bristle bundles and the stiffer peak area of bristle bundles in the inboard row.

* * * * *